US010928062B2

(12) United States Patent
Jang

(10) Patent No.: US 10,928,062 B2
(45) Date of Patent: Feb. 23, 2021

(54) COOKING DEVICE AND METHOD FOR CONTROLLING THE SAME

(71) Applicant: LG ELECTRONICS INC., Seoul (KR)

(72) Inventor: Unik Jang, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 690 days.

(21) Appl. No.: 15/000,830

(22) Filed: Jan. 19, 2016

(65) Prior Publication Data

US 2016/0209028 A1 Jul. 21, 2016

(30) Foreign Application Priority Data

Jan. 16, 2015 (KR) ..... 10-2015-0007750

(51) Int. Cl.

| | |
|---|---|
| ***F23D 14/10*** | (2006.01) |
| ***F23N 5/24*** | (2006.01) |
| ***F24C 3/12*** | (2006.01) |
| ***F24C 15/32*** | (2006.01) |
| ***F23D 99/00*** | (2010.01) |
| ***F23C 7/00*** | (2006.01) |
| ***F24C 3/04*** | (2006.01) |
| ***F24C 15/18*** | (2006.01) |

(52) U.S. Cl.

CPC ..... *F23D 14/10* (2013.01); *F23D 91/02* (2015.07); *F23N 5/245* (2013.01); *F24C 3/12* (2013.01); *F24C 15/322* (2013.01); *F23D 2207/00* (2013.01)

(58) Field of Classification Search

CPC ..... F23D 14/10; F23D 2207/00; F23D 91/02; F23N 5/245; F24C 15/322; F24C 3/12

See application file for complete search history.

(56) References Cited

U.S. PATENT DOCUMENTS 3,606,606 A * 9/1971 Luther ..... F23N 5/20 431/254
3,698,377 A * 10/1972 Smith ..... F24C 15/322 126/21 A
3,926,106 A * 12/1975 Deusing ..... A21B 1/28 126/21 A
3,967,281 A * 6/1976 Dageford ..... F22B 35/00 340/516

(Continued)

FOREIGN PATENT DOCUMENTS

DE 102005011021 A1 * 9/2006 ..... F23N 5/242
JP 09042674 A 2/1997

(Continued)

*Primary Examiner* — Jorge A Pereiro
*Assistant Examiner* — Logan P Jones
(74) *Attorney, Agent, or Firm* — Dentons US LLP

(57) ABSTRACT

Provided is a cooking device. The cooking device includes a frame to form a cooking chamber; a burner to heat the cooking chamber; a gas valve to control a flow of a gas which will be supplied to the burner; an ignition unit to ignite a mixed gas of the gas and air which is supplied to the burner; a fan to enable the air heated by the burner to flow; a fan motor to rotate the fan; and a control unit to control the fan motor, wherein, when the fan motor is normally operated, the control unit turns on the gas valve and operates the ignition unit.

10 Claims, 7 Drawing Sheets

(56) References Cited

U.S. PATENT DOCUMENTS

| | | | | | |
|---|---|---|---|---|---|
| 4,295,129 | A * | 10/1981 | Cade | F23N 5/242 | 340/520 |
| 4,340,355 | A * | 7/1982 | Nelson | F23N 1/065 | 236/15 BD |
| 4,477,019 | A * | 10/1984 | Breitbach | F24D 5/00 | 165/901 |
| 4,817,582 | A * | 4/1989 | Oslin | A21B 1/24 | 126/20 |
| 5,074,780 | A * | 12/1991 | Erdman | F23N 5/203 | 431/18 |
| 5,222,888 | A * | 6/1993 | Jones | F23N 3/082 | 431/12 |
| 5,524,556 | A * | 6/1996 | Rowlette | F23N 1/06 | 110/159 |
| 2005/0229918 | A1* | 10/2005 | Shim | F23D 14/72 | 126/39 BA |
| 2010/0085144 | A1* | 4/2010 | Aisa | G05B 19/0423 | 340/3.1 |
| 2015/0090705 | A1* | 4/2015 | Lim | F24C 15/2014 | 219/400 |
| 2015/0192307 | A1* | 7/2015 | Paller | F24C 15/322 | 126/273 R |

FOREIGN PATENT DOCUMENTS

| | | | | |
|---|---|---|---|---|
| JP | 2010-25404 | A | 2/2010 | |
| KR | 10-1999-0044909 | A | 6/1999 | |
| KR | 100619168 | B1 | 8/2006 | |
| NL | 1024026 | C2 * | 2/2005 | F04D 27/00 |

* cited by examiner

COOKING DEVICE AND METHOD FOR CONTROLLING THE SAME

CROSS-REFERENCE TO RELATED APPLICATION(S)

This application claims priority under 35 U.S.C. § 119 and 35 U.S.C. § 365 to Korean Patent Application No. 10-2015-0007750, filed in Korea on Jan. 16, 2015, which is hereby incorporated by reference.

BACKGROUND

1. Field of the Disclosure

The present disclosure relates to a cooking device and a method for controlling the same.

2. Background

A cooking device is a device for cooking food using heat from a heat source. For example, a cooking device generally includes an oven range having an oven chamber in which the food is cooked, and a burner provided in the oven chamber to burn gas.

An example of a conventional oven range is provided in Korean Patent Publication No. 2014-0067749 (published on Jun. 5, 2014). The gas oven range disclosed in Korean Patent Publication No. 2014-0067749 includes a cavity which forms an oven chamber, and a burner assembly which is installed at the cavity. The burner assembly includes a burner, a fan which enables air heated by a flame of the burner to flow in the oven chamber, and a fan motor which rotates the fan. Also, an air inlet port through which additional air is introduced may be formed at the cavity. A flow of the heated air is enabled by the fan rotated by the fan motor, and the additional air is introduced from an outside of the cavity by the flow of the air in the oven chamber.

As disclosed in Korean Patent Publication No. 2010-0013997, when a cooking start command is input, a fan motor operation command is input to the fan motor, and a mixed gas in which a gas is mixed with air is supplied toward the burner. However, when the fan motor is not operated, for example, when a connector for supplying electric power to the fan motor or a connector for providing a control signal to the fan motor is not normally connected, or when the fan motor is defective, the flame is generated from the burner, but the additional air is not supplied to the burner. If the additional air is not supplied to the burner, the mixed gas in which the gas is mixed with the air is incompletely burned, and thus carbon monoxide is generated.

Therefore, a technique for detecting whether the fan motor is normally operated is required, and a technique for preventing generation of carbon monoxide is also required.

SUMMARY

The present disclosure is directed to a cooking device which is able to detect whether a fan motor is normally operated, and enables a gas to be supplied to a burner when the fan motor is normally operated, and a method for controlling the same.

According to an embodiment of the present disclosure, there is provided a cooking device including a frame to form a cooking chamber, a burner to heat the cooking chamber, a gas valve to control a flow of a gas to be supplied to the burner, an ignition unit to ignite a mixture of the gas supplied to the burner and air, a fan to enable the air heated by the burner to flow, a motor to rotate the fan, and a control unit to control the motor, wherein, when the fan motor is operating in a normal state, the control unit turns on the gas valve and operates the ignition unit.

According to another embodiment of the present disclosure, there is provided a method for controlling a cooking device, including selecting a cooking mode and inputting a start command for the cooking device through a user interface, applying electric power to a fan motor by a control unit, determining an operating state of the fan motor by the control unit, and turning on a gas valve to supply a gas to a burner and operating an ignition unit when it is determined that the fan motor is operating in a normal state.

According to another embodiment of the present disclosure, there is provided another method for controlling a cooking device, including generating a flame from a burner by operating a fan motor and opening a gas valve, determining an operating state of the fan motor by a controller, closing the gas valve by the control unit to stop a supply of gas supplied to the burner when the fan motor is not operating in the normal state, and generating error information from a user interface.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF EXEMPLARY EMBODIMENTS

Reference will now be made in detail to the embodiments of the present disclosure, examples of which are illustrated in the accompanying drawings. Advantages, features, and methods for achieving those of embodiments may become apparent upon referring to embodiments described later in detail together with the attached drawings. However, embodiments are not limited to the embodiments disclosed hereinafter, but may be embodied in different modes. The same reference numbers may refer to the same elements throughout the specification.

Figure 1:
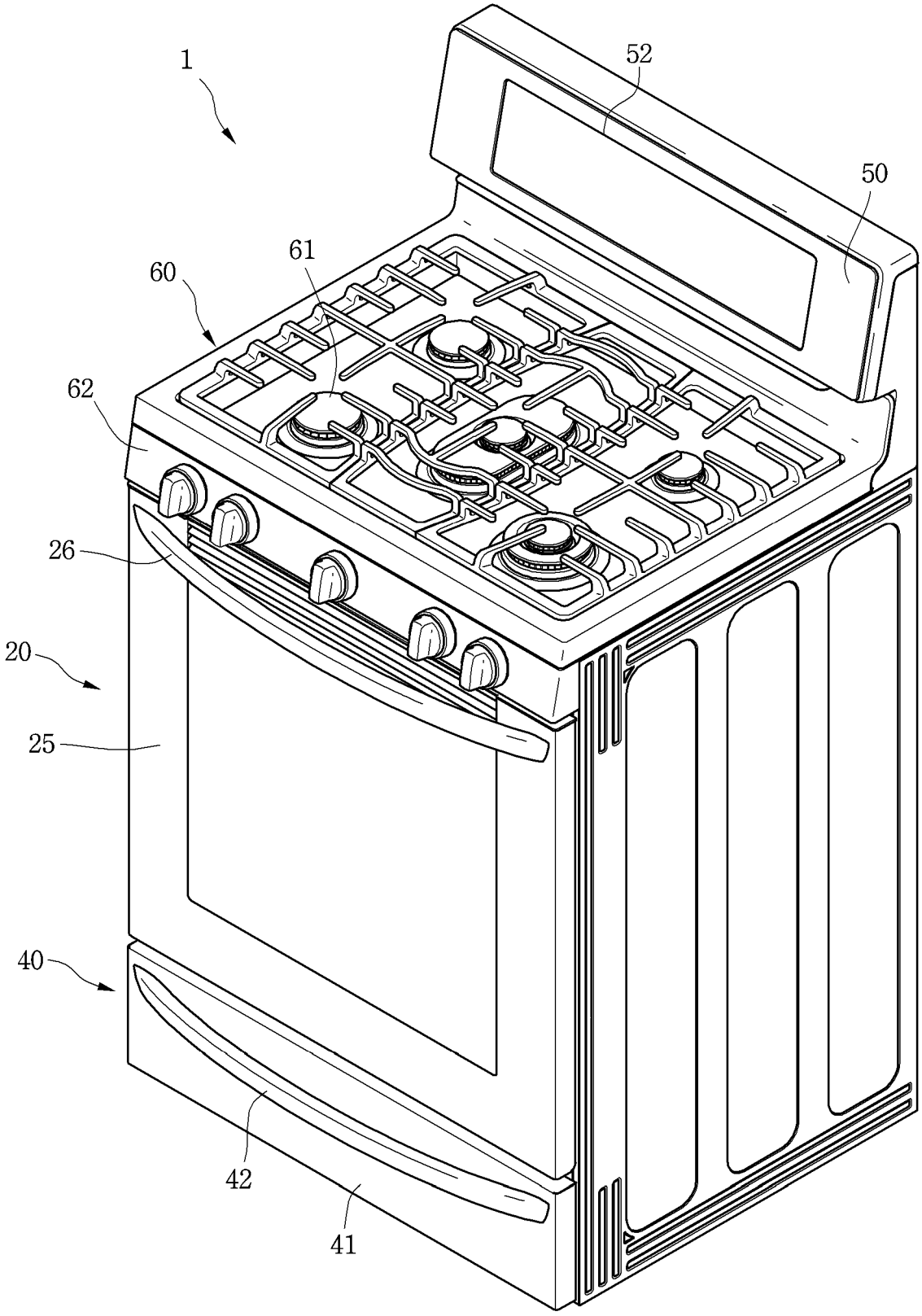
FIG. 1 is a perspective view of a cooking device according to an embodiment of the present disclosure.
Figure 2:
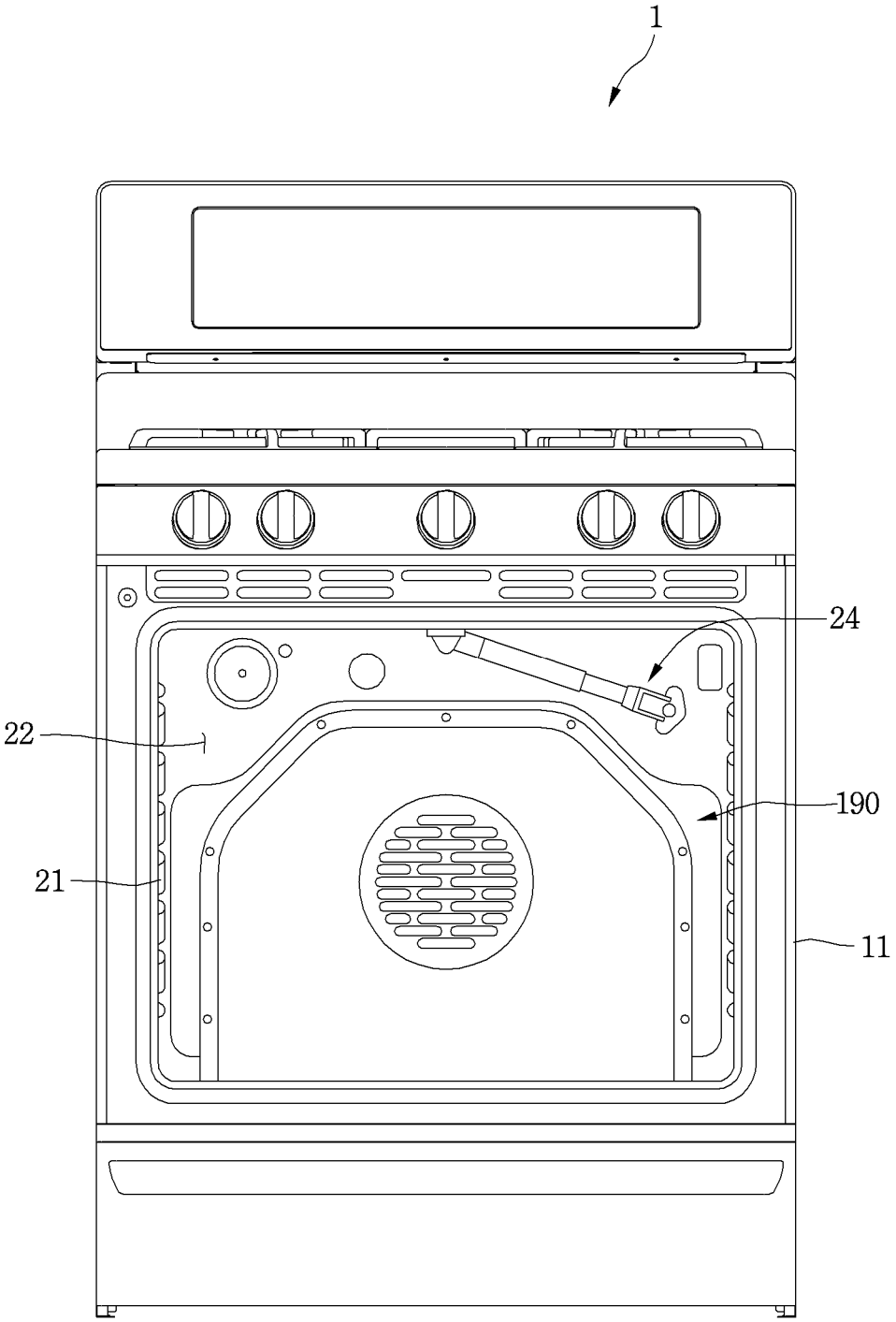
FIG. 2 is a front view illustrating a state in which a door is removed from the cooking device according to an embodiment of the present disclosure.
Figure 3:
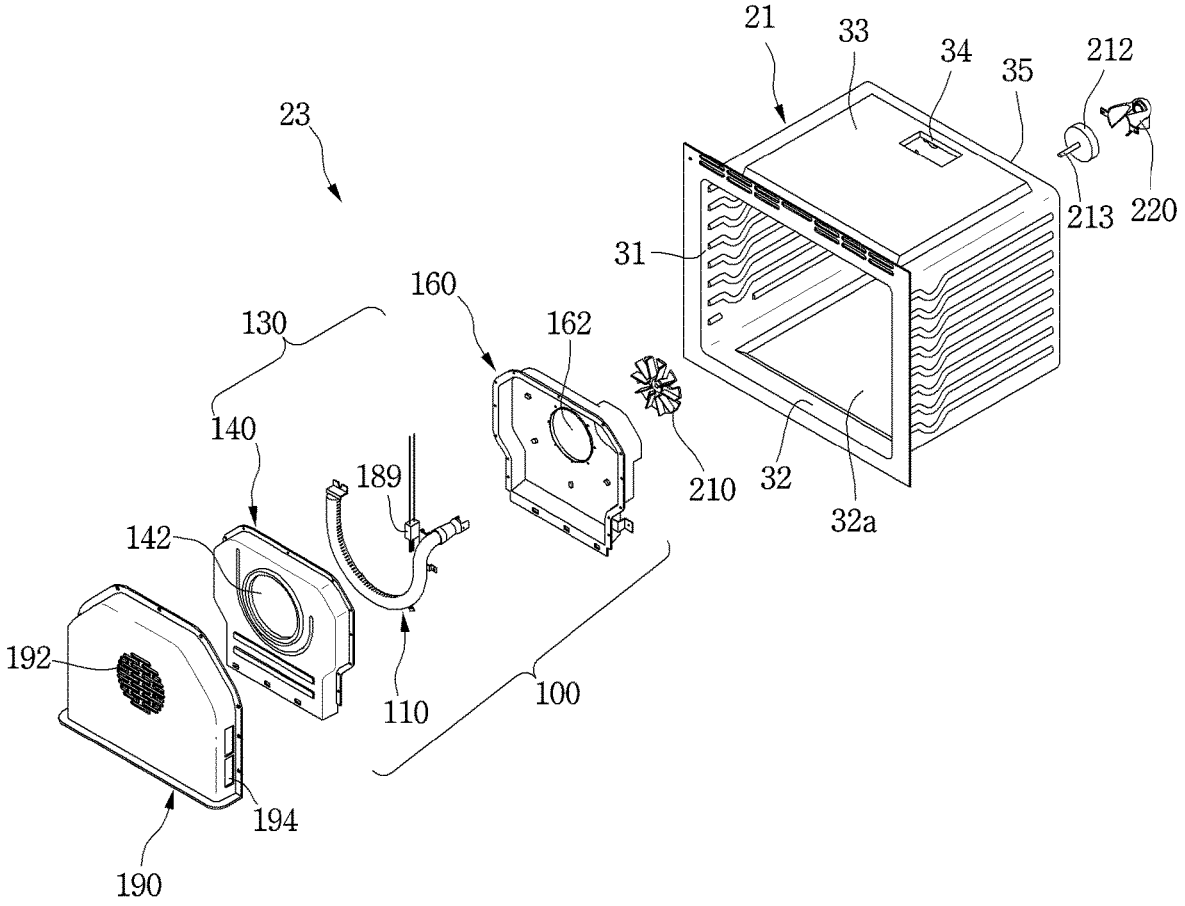
FIG. 3 is an exploded perspective view of a burner assembly according to an embodiment of the present disclosure.
Figure 4:
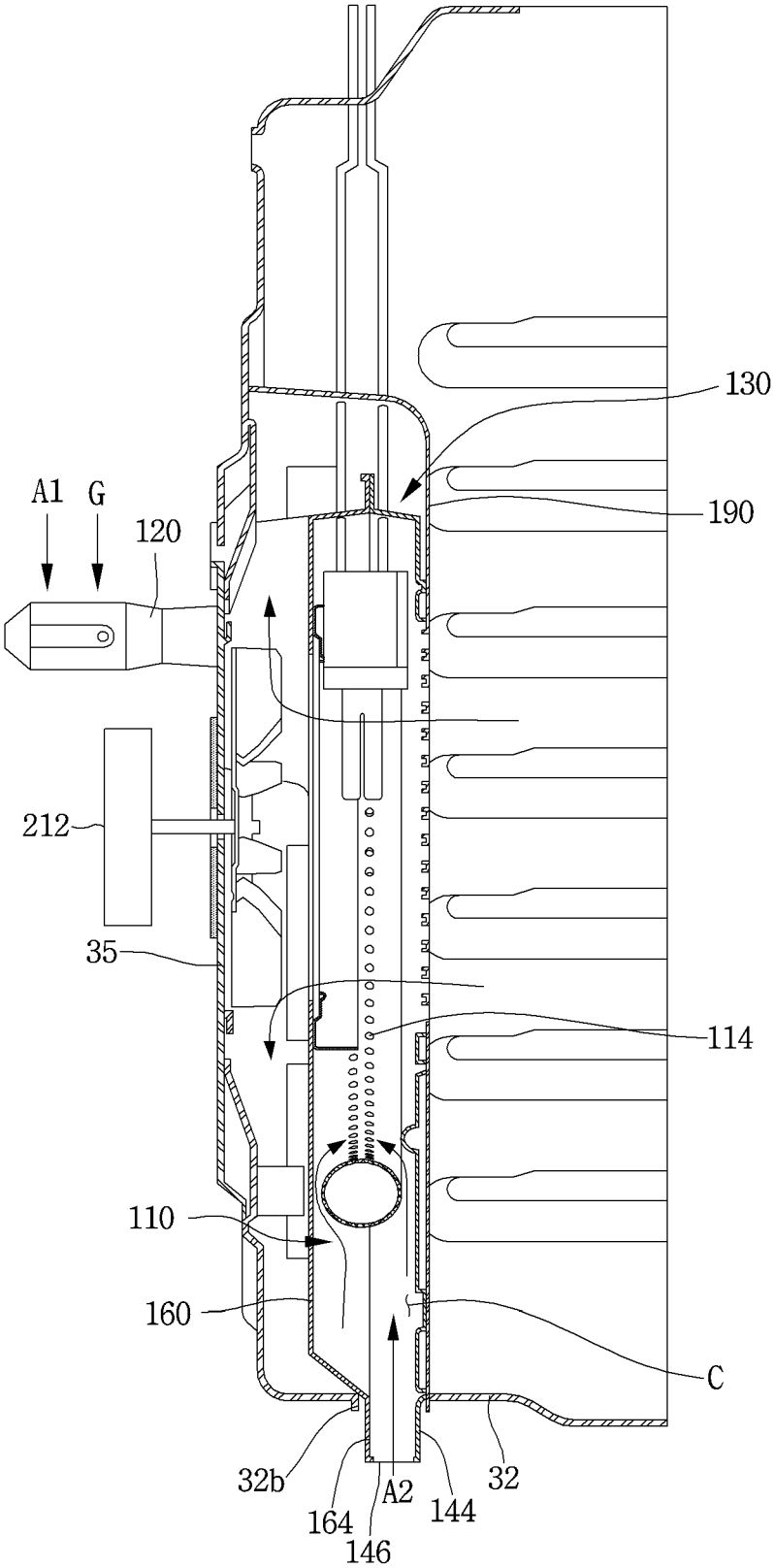
FIG. 4 is a vertical cross-sectional view illustrating a state in which the burner assembly is installed at a frame according to an embodiment of the present disclosure.

FIG. 1 is a perspective view of a cooking device according to an embodiment of the present disclosure, FIG. 2 is a front view illustrating a state in which a door is removed from cooking device according to an embodiment of the present disclosure, FIG. 3 is an exploded perspective view of a burner assembly according to an embodiment of the present disclosure, and FIG. 4 is a vertical cross-sectional view illustrating a state in which burner assembly is installed at a frame according to an embodiment of the present disclosure.

Referring to FIGS. 1, 2, 3, and 4, a cooking device 1 according to an embodiment of the present disclosure may include an oven unit 20.

Cooking device 1 may further include one or more of a cook-top unit 60 and a drawer unit 40. Cooking device 1 may further include a control panel 50. Cooking device 1 may further include an outer case 11. Outer case 11 may cover both side surfaces and rear surfaces of oven unit 20 and drawer unit 40.

It is understood that cook-top unit 60 and drawer unit 40 may be omitted according to a type of cooking device 1. Further, a plurality of oven units 20 may be provided.

Cook-top unit 60, oven unit 20 and drawer unit 40 may be provided at an upper portion, a center portion, and a lower portion of cooking device 1, respectively. Control panel 50 is provided at a rear portion of an upper surface of cooking device 1.

Cook-top unit 60 may include a plurality of cook-top burners 61. Cook-top burners 61 may heat a container in which food is provided or may directly heat the food using a flame generated by burning a gas, and thus may cook or heat the food. An operational unit 62 to operate the plurality of cook-top burners 61 may be provided at a front end of cook-top unit 60.

As another non-limiting example, cook-top unit 60 may include one or more electric heaters. However, the one or more electric heaters may be provided so not to be exposed or visible outside of cook-top unit 60.

Oven unit 20 may include a frame 21 which forms a cooking chamber 22. For example, frame 21 may be formed in a rectangular parallelepipe-like shape of which a front surface is open, but is not limited thereto.

Oven unit 20 may further include an upper burner 24 for cooking or heating food accommodated in cooking chamber 22. As another example, upper burner 24 may be replaced with an electric heater.

Oven unit 20 may further include a partition plate 190 to divide cooking chamber 22 into a first chamber 22*a* and a second chamber 22*b*. Partition plate 190 may be coupled to a rear wall 35 of frame 21 in cooking chamber 22.

Oven unit 20 may further include a burner assembly 23 provided in second chamber 22*b*. First chamber 22*a* may accommodate food item.

It is understood that burner assembly 23 and upper burner 24 may be simultaneously operated, or only one of them may be operated at a particular time. Upper burner 24 is provided above the food in cooking chamber 24 so as to provide heat to the food from above the food, and burner assembly 23 may be disposed at a rear of the food in cooking chamber 22.

Oven unit 20 may further include a door 25 to open and close access to cooking chamber 22. Door 25 may be rotatably connected to cooking device 1. For example, door 25 may open and close access to cooking chamber 22 in a pull-down method in which an upper end thereof is rotated up and down about a lower end thereof. It is understood that an operating method of door 25 is not limited in such embodiment.

A door handle 26 to be gripped or grasped by a user's hand to rotate door 25 may be provided at an upper end of a front surface of door 25.

Drawer unit 40 serves to a container, in which food may be put, and keep or maintain the container at a predetermined temperature. Drawer unit 40 may include a drawer 41 to accommodate the container. Drawer 41 may be inserted into or withdrawn from cooking device 1, such as in a sliding manner. A handle 42 which is gripped or grasped by the user may be provided at a front surface of drawer 41.

Control panel 50 may include a user interface 52 to receive an operation signal to operate cooking device 1. More particularly, control panel 50 may receive an operation signal to operate at least one of cook-top unit 60, oven unit 20 and drawer unit 40. User interface 52 may display a variety of information about operation of cooking device 1.

Frame 21 may include both side walls 31, a bottom wall 32, an upper wall 33 and a rear wall 35. According to the present embodiment, it is understood that a "front" is a direction toward a front surface of cooking device 1, and a "rear" is a direction toward a rear surface of cooking device 1. Regarding cooking chamber 22, it is understood that a "front" is a direction toward door 25 of oven unit 20, and a "rear" is a direction toward rear wall 35 of frame 21. The invention. however, is not limited to such description.

Partition plate 190 may be attached to rear wall 35 of frame 21. Accordingly, with partition plate 190 provided at rear wall 35 of frame 21, and burner assembly 23 provided at second chamber 22*b* formed between partition plate 190 and rear wall 35 of frame 21, a recessed portion 32*a* that is recessed downward may be formed at bottom wall 32 of frame 21, which increases a capacity of frame 21.

Burner assembly 23 may include a burner device 100, a fan 210, and a fan motor 212. Burner device 100 may include a burner 110 to generate the flame or fire by burning a gas.

Burner 110 is not limited, and may include an opened loop type burner tube. In other words, the burner tube may be formed in a non-annular shape. For example, the burner tube may be formed in a "U" shape, but is not limited thereto. Gas and air may be supplied to a first end of burner tube, and a second end of burner tube may be blocked.

A gas discharge hole 114 to discharge a mixed gas may be provided at burner 110. A burner hole (not shown) through which burner 110 passes or extends through may be formed at rear wall 35 of frame 21. In such arrangement, burner 110 is located at cooking chamber 22, and a part thereof may pass through the burner hole (not shown), and may be located between rear wall 35 of frame 21 and outer case 11.

An exhaust hole 34 through which an exhaust gas is discharged may be formed at upper wall 33 of frame 21. Exhaust hole 34 may be formed at rear wall 35 of frame 21 and not upper wall 33.

Burner device 100 may further include a burner cover 130 that covers burner 110. Burner cover 130 may include a first cover 140 and a second cover 160. For example, first cover 140 may cover burner 110 from a front side (e.g., first side) of burner 110, and second cover 160 may cover burner 110 from a rear side (e.g., second side) of burner 110.

A first opening 142 through which air of cooking chamber 22 passes may be formed at first cover 140, and a second opening 162 through which air passed through first opening 142 passes may be formed at second cover 160. First cover 140 may include a first insertion portion 144 which may pass through bottom wall 32 of frame 21, and second cover 160 may include a second insertion portion 164 which may pass through bottom wall 32 of frame 21.

Burner device 100 may further include an ignition unit 189 to ignite the mixed gas supplied to burner 110. For example, ignition unit 189 may be provided at burner 110, and a part of ignition unit 189 may pass through second cover 160 and upper wall 33 of frame 21. Ignition unit 189 may instead be provided at first cover 140 or second cover 160.

Fan 210 operates to flow the heated air in cooking chamber 22. Fan motor 212 may be disposed between rear wall 35 of frame 21 and outer case 11, and fan 210 may be located at second chamber 22*b* in cooking chamber 22.

Therefore, a shaft 213 of fan motor 212 may pass through rear wall 35 of frame 21 and may be coupled to fan 210. Fan motor 212 may be fixed to rear wall 35 of frame 21 or outer case 11 by a motor mount which is not illustrated.

Partition plate 190 may protect burner device 100. For example, partition plate 190 may prevent a food item from moving to burner device 100 during cooking. Partition plate 190 may have an air suction port 192 through which air in cooking chamber 22 is suctioned, and an air discharge port 194 through which air heated by burner device 100 is discharged to cooking chamber 22.

While partition plate 190 is attached to rear wall 35 of frame 21, a lower end of partition plate 190 may be in contact with bottom wall 32 of frame 21. Partition plate 190 may be in contact with bottom wall 32 of frame 21 between recessed portion 32*a* of bottom wall 32 and rear wall 35.

Burner assembly 23 may further include a nozzle holder 220 to inject the gas to burner 110. Nozzle holder 220 may be located between rear wall 35 of frame 21 and outer case 11, and may be attached to, for example, rear wall 35 of frame 21. As another example, when an insulating material is installed at an outside of frame 21, nozzle holder 220 may be installed at the insulating material. Nozzle holder 220 may include a nozzle that is aligned with burner 110 passed through rear wall 35 of frame 21 and injects gas to burner 110.

A through-hole 32*b* through which insertion portions 144 and 164 of burner cover 130 pass may be formed at bottom wall 32 of frame 21. Therefore, as insertion portions 144 and 164 of burner cover 130 pass through through-hole 32*b*, insertion portions 144 and 164 are located at an outside of frame 21.

Portions of first insertion portion 144 of first cover 140 and second insertion portion 164 of second cover 160 are spaced apart from each or, and form an introduction hole 146.

Fan 210 is provided at an exhaust path P1 which is an outer space of a combustion chamber C. Exhaust path P1 (which may be referred to as an "exhaust chamber") may be formed near an outer surface of burner cover 130, rear wall 35 of frame 21, and partition plate 190.

Hereinafter, an operation of burner assembly 23 is described.

When operation of burner assembly 100 is started, gas is injected from nozzle provided at nozzle holder 220 to burner 110. Then, air A1 (which is air outside of frame) around burner 110 is supplied to burner 110 together with gas G. At this time, since a lower pressure is formed around gas supplied to burner 110, air A1 around burner 110 may be naturally supplied to burner 110 by a pressure difference.

And since insertion portions 144 and 164 of burner cover 130 pass through bottom wall 32 of frame 21 and are located at an outside of frame 21, additional air A2 to burn the mixed gas in burner 110 may be introduced into combustion chamber C through introduction hole 146 of burner cover 130.

Additional air A2 introduced into combustion chamber C may flow toward burner 110.

Meanwhile, when mixed gas is supplied to burner 110, mixed gas is ignited by ignition unit 189, and thus flame is generated at burner 110. And fan motor 212 is turned on, and fan 210 is rotated.

When fan 210 is rotated, air in first chamber 22*a* is introduced into combustion chamber C of second chamber 22*b* through air suction port 192 of partition plate 190. At this time, air introduced into combustion chamber C passes through an area formed by an inner circumferential surface of burner 110.

Air introduced into combustion chamber C is heated by flame generated from burner 110, and then discharged from combustion chamber C.

air discharged from combustion chamber C flows through exhaust path P1 between second cover 160 and rear wall 35 of frame 21, and is discharged to first chamber 22*a* through air discharge port 194 of partition plate 190.

above-described embodiment has described that burner assembly is installed at rear wall of frame from an inside of frame. However, unlike this, burner assembly may be installed at rear wall of frame from an outside of frame.

Alternatively, burner assembly may be formed at one of both side walls of frame.

The above-described embodiment has described that burner cover 130 includes two covers and forms combustion chamber C. However, unlike this, one or three or more covers may form combustion chamber C. That is, as long as combustion chamber C and exhaust path P1 can be divided, a type of burner cover 130 and a number of covers included in burner cover are not limited.

Also, above-described embodiment has described that fan is installed at a rear of burner cover, and air heated by burner flows toward fan. However, unlike this, fan may be installed at a front of burner cover so that air passed through fan is heated by burner. However, in case of former, fan may be a fan by which air flowed in an axial direction is discharged in a radial direction, and in case of latter, fan may be a fan by which air flowed in axial direction is discharged in axial direction.

Figure 5:
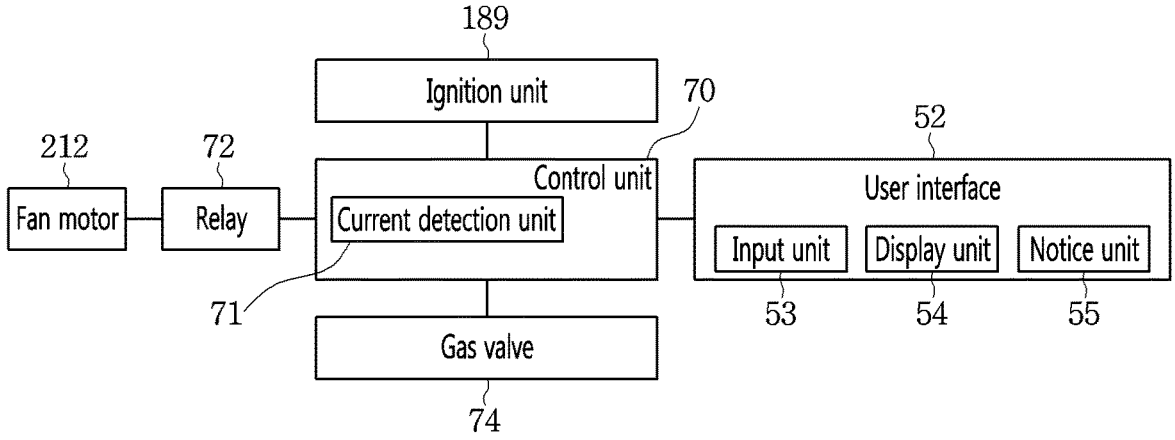
FIG. 5 is a block diagram illustrating a configuration of the cooking device according to an embodiment of the present disclosure.

FIG. 5 is a block diagram illustrating a configuration of cooking device according to an embodiment of the present disclosure.

Referring to FIG. 5, cooking device 1 according to an embodiment of the present disclosure may include a gas valve 74 which controls a flow of gas to be supplied toward burner 110, and a control unit 70 which controls gas valve 74.

Gas valve 74 may cut off flow of gas, or may allow flow of gas. Also, gas valve 74 may control a flow rate of flowing gas.

Cooking device 1 may further include a relay 72. Relay 72 may be turned on when a cooking start command is input.

Relay 72 may be connected to fan motor 212. When relay 72 is turned on, electric power may be applied to fan motor 212.

Fan motor 212 may be connected to relay 72 through a connector. It is understood that relay 72 may be omitted. In this case, fan motor 212 may be connected to control unit 70 through connector.

Control unit 70 may also control ignition unit 189 and fan motor 212.

Cooking device 1 may further include user interface 52. User interface 52 may include an input unit 53 which selects a cooking mode and also inputs cooking start command or like.

User interface 52 may further include a display unit 54 which display the variety of information. For example, display unit 54 may display a selected cooking mode. Also, display unit 54 may further display one or more of a remaining cooking time and a target cooking temperature.

Input unit 53 may be provided separately from display unit 54. Alternatively, a touch screen in which input unit 53 and display unit 54 are integrated may be provided.

User interface 52 may further include a notice unit 55 to generate error information of at least fan motor 212.

Control unit 70 may include a current detection unit 71 to detect a current of fan motor 212. Alternatively, control unit 70 may include a current detection function which detects current of fan motor 212.

The control unit 70 may determine whether fan motor 212 is normally operated based on current of fan motor 212. If it is determined that fan motor 212 is normally operated, control unit 70 may turn on gas valve 74, and may operate ignition unit 189.

Figure 6:
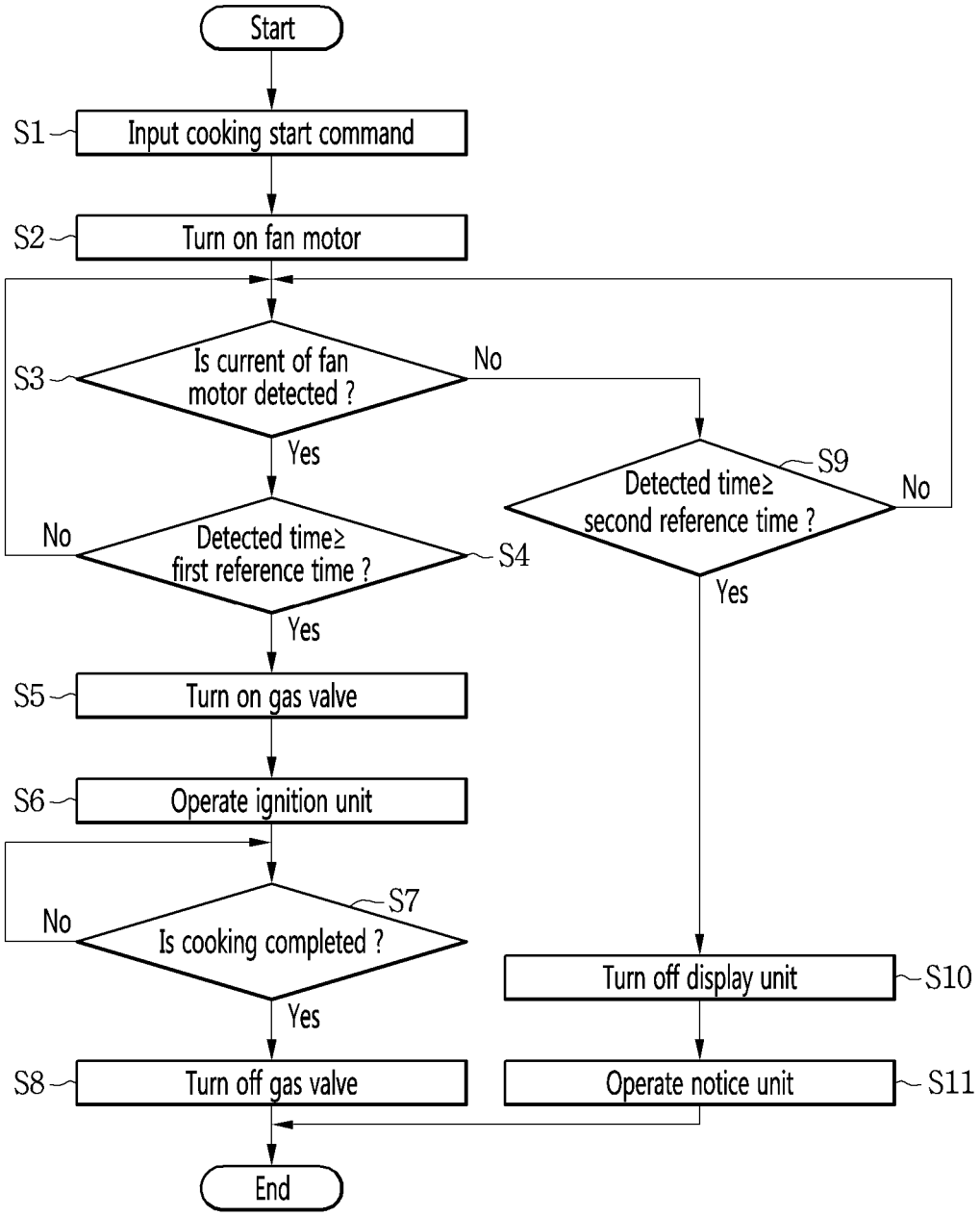
FIG. 6 is a flowchart illustrating a method for controlling the cooking device according to an embodiment of the present disclosure.

FIG. 6 is a flowchart illustrating a method for controlling cooking device according to an embodiment of the present disclosure.

Referring to FIGS. 1 through 6, through user interface 52, cooking mode may be selected and cooking start command may be input (S1).

When cooking start command is input, selected cooking mode may be displayed on display unit 54. The target cooking temperature and remaining cooking time until completion of cooking may be additionally displayed on display unit 54, but disclosed embodiments of invention are not limited thereto.

When cooking start command is input, control unit 70 turns on fan motor 212. For example, control unit 70 turns on relay 72 connected to fan motor 212.

When relay 72 is turned on, fan motor 212 is in a state in which electric power may be applied thereto. When fan motor 212 is normally connected to relay 72, the electric power may be normally applied to fan motor 212.

In the specification, a state in which fan motor 212 is normally operated may be referred to as a normal state of fan motor 212, and a state in which fan motor 212 is not normally connected to relay 72 or fan motor 212 is damaged and thus is not normally operated may be referred to as an abnormal state of fan motor 212.

Control unit 70 may determine whether current in fan motor 212 is detected through current detection unit 71 (S3). That is, in the embodiment, whether fan motor 212 is normally operated may be determined based on current of fan motor 212 detected by current detection unit 71.

As a result determined in an operation S3, when current is detected by current detection unit 71, control unit 70 determines whether a time for which current is detected in current detection unit 71 is a first reference time or more (S4).

As a result determined in an operation S4, when time for which current is detected in current detection unit 71 is first reference time or more, control unit 70 determines that fan motor 212 is in normal state. When fan motor 212 is in the normal state, fan 210 may be normally rotated.

In the embodiment, reason why it is determined that fan motor 212 is in the normal state when the time for which the current is detected in current detection unit 71 is the first reference time or more is to prevent a case in which it is erroneously determined that fan motor 212 is in normal state due to a current detection error of current detection unit 71.

When it is determined that fan motor 212 is normally operated, control unit 70 turns on gas valve 74 (S5). When gas valve 74 is turned on, gas may be supplied to burner 110 from nozzle of nozzle holder 220.

And control unit 70 operates ignition unit 189 (S6). If ignition unit 189 is operated, mixed gas discharged from burner 110 is burned, and flame is generated, and thus food in cooking chamber 22 may be cooked.

Control unit 70 may enable gas valve 74 to be maintained in an ON state during cooking process, or may control an amount of gas flowing through gas valve 74. Also, control unit 70 may enable fan motor 212 to be continuously turned on or to be repeatedly turned on and off during cooking process.

Control unit 70 may determine whether cooking is completed (S7), and then may turn off gas valve 74 when the cooking is completed (S8). Of course, when the cooking is completed, fan motor 212 may also be turned off.

However, as a result determined in operation S3, when it is determined that current is not detected by current detection unit 71, it may be determined whether a time for which current is not detected is a second reference time or more (S9). At this time, second reference time may be same as or different from first reference time.

In the embodiment, reason why it is determined that fan motor 212 is in the abnormal state when the time for which the current is not detected is the second reference time or more is to prevent a case in which it is erroneously determined that fan motor 212 is in abnormal state due to the current detection error of current detection unit 71.

As a result determined in an operation S9, when the time for which the current is not detected is the second reference time or more, control unit 70 determines that fan motor 212 is in abnormal state, and then turns off display unit 54 (S10). Alternatively, some of the variety of information displayed on display unit 54 which is in ON state may be not displayed.

Also, control unit 70 may operate notice unit 55 so that error information is generated from notice unit 55. Notice unit 55 may be a buzzer circuit or a speaker, but is not limited thereto.

According to an embodiment of the present disclosure, when fan motor 212 is normally operated after the cooking start command is input, gas valve 74 is turned on, and ignition unit 189 is operated so that burning of the gas occurs in burner 110, and thus generation of carbon monoxide due to incomplete combustion of the mixed gas may be prevented.

Also, because it may be determined whether fan motor 212 is normally operated, the error information may be generated from notice unit 55, and thus the user may easily confirm the abnormal state of fan motor 212.

Figure 7:
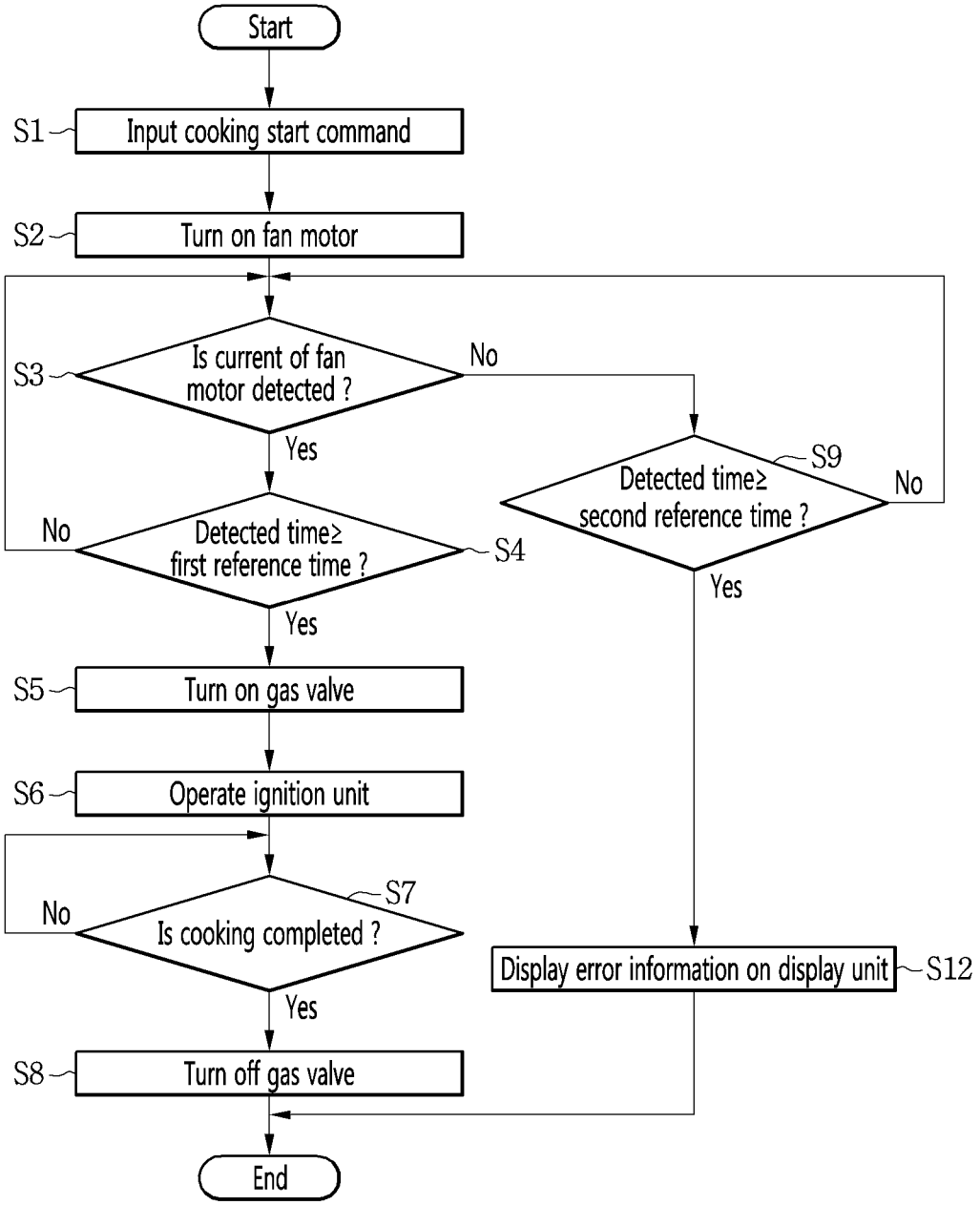
FIG. 7 is a flowchart illustrating a method for controlling the cooking device according to another embodiment of the present disclosure.

FIG. 7 is a flowchart illustrating a method for controlling the cooking device according to another embodiment of the present disclosure.

Referring to FIG. 7, operations S1 to S9 in the method for controlling the cooking device illustrated in FIG. 6 are the same as those in a method for controlling the cooking device according to an embodiment of the present disclosure.

In the embodiment, when the time for which the current is not detected is the second reference time or more, control unit 70 determines that fan motor 212 is in the abnormal state, and then may enable the error information to be displayed on display unit 54 (S12). Of course, in the embodiment, the error information may be generated from notice unit 55, and notice unit 55 may also be omitted.

In the above-described embodiments, when the time for which the current is detected is the first reference time or more, it is determined that the fan motor is normally operated. However, unlike this, when the current of the fan motor is detected by current detection unit 71 and a time for which a detected current value is within a normal current range is the first reference time, it may be determined that the fan motor is normally operated.

Therefore, when the current is detected and the time for which a detected current value is within the normal current range is less than the first reference time, it may be determined that the fan motor is not normally operated.

The structure of the burner assembly described in the specification is only an example. The structure of the burner assembly is not limited, as long as the control method illustrated in FIG. 6 or 7 may be applied.

Also, although the above-described embodiments may have described that the additional air is introduced from the lower side of the frame into the combustion chamber, it is understood that additional air may be introduced from a rear side of the frame into the combustion chamber.

Meanwhile, although the above-described embodiments have described that whether the fan motor is normally operated is determined at an early stage in which the cooking start command is input, it is understood that whether the fan motor is normally operated may be determined during the cooking process. In other words, for example, when the current of the fan motor is continuously detected during the cooking process and the time for which the current of the fan motor is not detected is a third reference time or more, the control unit may turn off the gas valve and may stop the cooking. Then, the error information may be generated from the notice unit, or the error information may be displayed on the display unit. At this time, the third reference time may be the same as or different from the second reference time.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations/modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A cooking device comprising:

a frame to form a cooking chamber;

a burner to heat the cooking chamber;

a gas valve to control a flow of a gas to be supplied to the burner;

an ignition unit to ignite a mixture of the gas supplied to the burner and air;

a fan to enable the air heated by the burner to flow;

a fan motor to rotate the fan;

a display unit to display information;

a user interface configured to select a cooking mode and input a start command, and a control unit to control the motor, the control unit comprising a current detection unit to detect a current level of the fan motor, wherein the control unit turns on the fan motor when cooking start command is input by the user interface, wherein the control unit determines whether current in the fan motor is detected through the current detection unit when the cooking start command is input, wherein the control unit determines a time for which is detected current in the fan motor, when the current in the fan motor is detected, wherein the control unit determines a time for which is not detected current in the fan motor, when the current in the fan motor is not detected, wherein the control unit determines that the fan motor is operating in a normal state when the time for which is detected current in the fan motor is a first reference time or more, when the current in the fan motor is detected, wherein the control unit determines that the fan motor is operating in an abnormal state when the time for which is not detected current in the fan motor is a second reference time or more, when the current in the fan motor is not detected, wherein the control unit determines whether current in the fan motor is re-detected through the current detection unit, when the time for which is detected current in the fan motor is less than the first reference time, when the current in the fan motor is detected, wherein the control unit determines whether current in the fan motor is re-detected through the current detection unit, when the time for which is not detected current in the fan motor is less than the second reference time, when the current in the fan motor is not detected, wherein the control unit determines that the fan motor is not operating in the normal state and turns off the display unit when a time when the current of the fan motor is not detected is greater than or equal to the second reference time in order to prevent an erroneous determination by the control unit that the fan motor is not operating in the normal state due to a current error detection of the current detection unit, wherein when it is determined that the fan motor is operating in the normal state, the control unit turns on the gas valve and operates the ignition unit, and wherein the control unit continuously detects the current of the fan motor during a cooking process and when the time for which the current of the fan motor is not detected is greater than or equal to a third reference time, the control unit turns off the gas valve and the ignition unit.

2. The cooking device of claim 1, further comprising a relay connected to the fan motor and the control unit, wherein the control unit turns on the relay to operate the fan motor.

3. The cooking device of claim 1, wherein, when the fan motor is not operating in the normal state, the user interface generates an error information.

4. The cooking device of claim 3, wherein the user interface further comprises the display unit to display the cooking mode, and when the control unit determines that the fan motor is not operating in the normal state, the error information is displayed on the display unit.

5. The cooking device of claim 3, wherein the user interface further comprises a notice unit to generate the error information.

6. The cooking device of claim 1, wherein, when the gas valve is turned on and the mixed gas is burned at the burner by the ignition unit, the control unit determines whether the fan motor is operating in the normal state.

7. The cooking device of claim 6, wherein the control unit turns off the gas valve when the control unit determines that the fan motor is not operating in the normal state.

8. A method for controlling a cooking device, comprising:

selecting a cooking mode and inputting a start command for the cooking device through a user interface;

applying electric power to a fan motor by a control unit;

determining an operating state of the fan motor by the control unit; and turning on a gas valve to supply a gas to a burner and operating an ignition unit when it is determined that the fan motor is operating in a normal state, wherein the determining of the operating state of the fan motor comprises:

detecting a current level of the fan motor via a current detection unit, and determining whether the detected current level is within a normal current range and a time when the detected current level is within the normal current range is greater than or equal to a reference time, wherein the control unit turns on the fan motor when cooking start command is input by the user interface, wherein the control unit determines whether current in the fan motor is detected through the current detection unit when the cooking start command is input, wherein the control unit determines a time for which is detected current in the fan motor, when the current in the fan motor is detected, wherein the control unit determines a time for which is not detected current in the fan motor, when the current in the fan motor is not detected, wherein the control unit determines that the fan motor is operating in the normal state when the time for which is detected current in the fan motor is a first reference time or more, when the current in the fan motor is detected, wherein the control unit determines that the fan motor is operating in an abnormal state when the time for which is not detected current in the fan motor is a second reference time or more, when the current in the fan motor is not detected, wherein the control unit determines whether current in the fan motor is re-detected through the current detection unit, when the time for which is detected current in the fan motor is less than the first reference time, when the current in the fan motor is detected, wherein the control unit determines whether current in the fan motor is re-detected through the current detection unit, when the time for which is not detected current in the fan motor is less than the second reference time, when the current in the fan motor is not detected, wherein the control unit determines that the fan motor is not operating in the normal state and turns off a display unit, when a time when the current of the fan motor is not detected is greater than or equal to the second reference time in order to prevent an erroneous determination by the control unit that the fan motor is not operating in the normal state due to a current error detection of the current detection unit, wherein the control unit continuously detects the current of the fan motor during a cooking process and when the time for which the current of the fan motor is not detected is greater than or equal to a third reference time, the control unit turns off the gas valve and the ignition unit.

9. The method of claim 8, further comprising generating error information from a notice unit or a display unit when the fan motor is not operating in the normal state.

10. A method for controlling a cooking device, comprising:

generating a flame from a burner by operating a fan motor and opening a gas valve;

determining an operating state of the fan motor by a control unit;

closing the gas valve by the control unit to stop a supply of gas supplied to the burner when the fan motor is not operating in a normal state; and generating error information from a user interface, wherein the determining of the operating state of the fan motor comprises:

detecting a current level of the fan motor via a current detection unit, and determining whether the detected current level is within a normal current range and a time when the detected current is within the normal current range is greater than or equal to a reference time, wherein the control unit turns on the fan motor when a cooking start command is input by the user interface, wherein the control unit determines whether current in the fan motor is detected through the current detection unit when the cooking start command is input, wherein the control unit determines a time for which is detected current in the fan motor, when the current in the fan motor is detected, wherein the control unit determines a time for which is not detected current in the fan motor, when the current in the fan motor is not detected, wherein the control unit determines that the fan motor is operating in the normal state when the time for which is detected current in the fan motor is a first reference time or more, when the current in the fan motor is detected, wherein the control unit determines that the fan motor is operating in an abnormal state when the time for which is not detected current in the fan motor is a second reference time or more, when the current in the fan motor is not detected, wherein the control unit determines whether current in the fan motor is re-detected through the current detection unit, when the time for which is detected current in the fan motor is less than the first reference time, when the current in the fan motor is detected, wherein the control unit determines whether current in the fan motor is re-detected through the current detection unit, when the time for which is not detected current in the fan motor is less than the second reference time, when the current in the fan motor is not detected, wherein the control unit determines that the fan motor is not operating in the normal state and turns off a display unit, when a time when the current of the fan motor is not detected is greater than or equal to the second reference time in order to prevent an erroneous determination by the control unit that the fan motor is not operating in the normal state due to a current error detection of the current detection unit, wherein the control unit continuously detects the current of the fan motor during a cooking process and when the time for which the current of the fan motor is not detected is greater than or equal to a third reference time, the control unit turns off the gas valve and the ignition unit.

* * * * *